US011671778B1

(12) United States Patent
Jacob et al.

(10) Patent No.: US 11,671,778 B1
(45) Date of Patent: Jun. 6, 2023

(54) ACOUSTIC RECEIVERS WITH MULTIPLE DIAPHRAGMS

(71) Applicant: Knowles Electronics, LLC, Itasca, IL (US)

(72) Inventors: Donald Verghese Jacob, Chicago, IL (US); Christopher Monti, Elgin, IL (US); Matthew Manley, Crystal Lake, IL (US); Kalyan Nadella, Chicago, IL (US); Yahui Zhang, Schaumburg, IL (US)

(73) Assignee: KNOWLES ELECTRONICS, LLC, Itasca, IL (US)

( * ) Notice: Subject to any disclaimer, the term of this patent is extended or adjusted under 35 U.S.C. 154(b) by 0 days.

(21) Appl. No.: 17/566,001

(22) Filed: Dec. 30, 2021

(51) Int. Cl.

| | |
|---|---|
| ***H04R 31/00*** | (2006.01) |
| ***H04R 9/06*** | (2006.01) |
| ***H04R 7/20*** | (2006.01) |
| ***H04R 11/02*** | (2006.01) |

(52) U.S. Cl.
CPC ..... *H04R 31/003* (2013.01); *H04R 7/20* (2013.01); *H04R 9/06* (2013.01); *H04R 11/02* (2013.01)

(58) Field of Classification Search
CPC ..... H04R 31/003; H04R 7/20; H04R 9/06; H04R 11/02; H04R 9/02
See application file for complete search history.

(56) References Cited

U.S. PATENT DOCUMENTS

| | | | |
|---|---|---|---|
| 1,579,595 | A | 4/1926 | Cole et al. |
| 2,081,619 | A | 5/1937 | Ebert |
| 6,563,933 | B1 | 5/2003 | Niederdraenk |
| 6,931,140 | B2 | 8/2005 | Halteren et al. |
| 7,103,196 | B2 | 9/2006 | Warren |
| 7,194,102 | B2 | 3/2007 | Harvey |
| 7,203,334 | B2 | 4/2007 | Schafer et al. |
| 7,302,748 | B2 | 12/2007 | Jiles et al. |
| 7,336,797 | B2 | 2/2008 | Thompson et al. |
| 7,415,125 | B2 | 8/2008 | Warren et al. |

(Continued)

FOREIGN PATENT DOCUMENTS

| | | |
|---|---|---|
| CN | 204291354 | 4/2015 |
| CN | 204291354 U | 4/2015 |

(Continued)

*Primary Examiner* — Sunita Joshi

(57) ABSTRACT

A sound-producing balanced armature receiver, as disclosed, includes a receiver housing with a first internal volume, a second internal volume, and a sound outlet. The receiver includes a first diaphragm separating the first internal volume into a first front volume and a first back volume and a second diaphragm separating the second internal volume into a second front volume and a second back volume. The receiver also includes a motor inside the first back volume of the housing such that the motor includes an armature mechanically coupled to both the first diaphragm and the second diaphragm, an acoustic seal between the first front volume and the second back volume such that the acoustic seal accommodates the mechanical coupling of the armature to the second diaphragm while providing acoustic separation between the first internal volume and the second internal volume, and a back-volume increasing structure attached externally to the housing and acoustically coupled with the second back volume to provide additional volume to the second back volume.

20 Claims, 11 Drawing Sheets

(56) References Cited

U.S. PATENT DOCUMENTS

| | | | | |
|---|---|---|---|---|
| 7,577,269 | B2 | 8/2009 | Adelman | |
| 7,860,264 | B2 * | 12/2010 | Jiles | H04R 7/10 381/175 |
| 7,912,240 | B2 | 3/2011 | Madaffari et al. | |
| 9,137,605 | B2 | 9/2015 | Manley et al. | |
| 9,571,941 | B2 | 2/2017 | Heidenreich et al. | |
| 10,009,693 | B2 | 6/2018 | Halteren et al. | |
| 2012/0057734 | A1 | 3/2012 | Ambrose et al. | |
| 2013/0284537 | A1 | 10/2013 | LoPresti et al. | |
| 2015/0373456 | A1 | 12/2015 | Dayton et al. | |
| 2016/0255433 | A1 * | 9/2016 | Grinker | H04R 1/1016 381/380 |
| 2019/0342666 | A1 | 11/2019 | Dayton et al. | |
| 2021/0204065 | A1 | 7/2021 | Albahri et al. | |
| 2021/0204066 | A1 | 7/2021 | Nadella et al. | |
| 2022/0150643 | A1 | 5/2022 | Albahri et al. | |

FOREIGN PATENT DOCUMENTS

| | | | |
|---|---|---|---|
| CN | 204350282 | | 5/2015 |
| CN | 204350282 | U | 5/2015 |
| CN | 204350283 | | 5/2015 |
| CN | 204350283 | U | 5/2015 |
| CN | 204350285 | | 5/2015 |
| CN | 204350285 | U | 5/2015 |
| CN | 204350286 | | 5/2015 |
| CN | 204350286 | U | 5/2015 |
| CN | 205830004 | U | 12/2016 |
| CN | 107222810 | A | 9/2017 |
| WO | 2018148485 | A1 | 8/2018 |

* cited by examiner

ACOUSTIC RECEIVERS WITH MULTIPLE DIAPHRAGMS

TECHNICAL FIELD

This disclosure relates generally to acoustic devices and more specifically to balanced armature acoustic receivers with multiple diaphragms.

BACKGROUND

Acoustic devices including a balanced armature receiver that converts an electrical input signal to an acoustic output signal characterized by a varying sound pressure level (SPL) are generally known. Such acoustic devices may be integrated in hearing aids, headsets, hearables, or ear buds among other hearing devices worn by a user. The receiver generally includes a motor and a coil to which an electrical excitation signal is applied. The coil is disposed about a portion of an armature (also known as a reed), a movable portion of which is disposed in equipoise between magnets, which are typically retained by a yoke. Application of the excitation or input signal to the receiver coil modulates the magnetic field, causing deflection of the reed between the magnets. The deflecting reed is linked to a movable portion of a diaphragm disposed within a partially enclosed receiver housing such that movement of the paddle forces air through a sound outlet or port of the housing.

As the size of sound-producing acoustic devices like balanced armature receivers are reduced to accommodate increasingly smaller space allocations in host hearing devices, the acoustic devices may increase in acoustic stiffness, thereby affecting the sound output produced. Thus there is a need to reduce the acoustic stiffness and improve the sound output of balanced armature receivers without substantially increasing its size.

BRIEF DESCRIPTION OF THE DRAWINGS

The objects, features, and advantages of the present disclosure will be more apparent to those of ordinary skill in the art upon consideration of the following Detailed Description with reference to the accompanying drawings.

Figure 1:
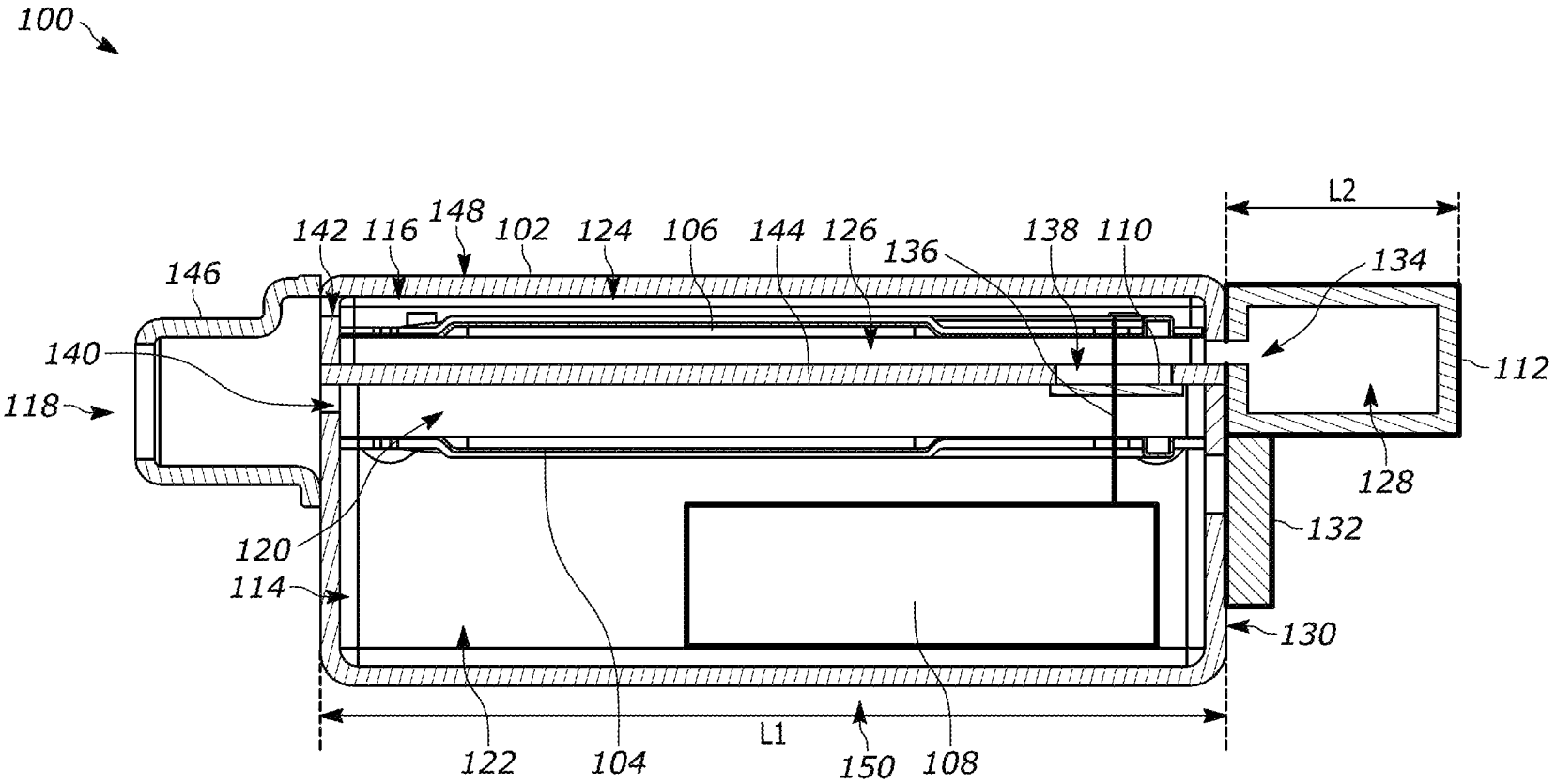
FIG. 1 shows a cross-sectional view of an acoustic receiver according to an embodiment.

Those of ordinary skill in the art will appreciate that elements in the figures are illustrated for simplicity and clarity. It will be further appreciated that certain actions or steps may be described or depicted in a particular order of occurrence while those of ordinary skill in the art will understand that such specificity with respect to sequence is not actually required unless a particular order is specifically indicated. It will also be understood that the terms and expressions used herein have the ordinary meaning as is accorded to such terms and expressions with respect to their corresponding respective fields of inquiry and study except where specific meanings have otherwise been set forth herein.

DETAILED DESCRIPTION

The present disclosure pertains to sound-producing acoustic receivers (also referred to herein as "receivers") for use in hearing devices, like behind-the-ear (BTE), in-the-ear (ITE), in-the-canal (ITC) and receiver-in-canal (RIC) hearing aids. Such receivers may also be used in headsets, wired or wireless earbuds or earpieces, or in some other hearing device that extends into, on or may be placed in close proximity to a user's ear.

The present disclosure pertains to sound-producing balanced armature acoustic receivers having multiple diaphragms. In certain implementations, the sound-producing acoustic receivers have multiple internal volumes defined by a housing, each of which is separated into a front volume and a back volume by a diaphragm. In some examples, the acoustic receiver has a motor disposed at least partially inside the housing, where the motor includes an armature that is mechanically coupled to the diaphragms. Also, an acoustic seal acoustically separates one of the front volumes from one of the back volumes while accommodating the mechanical coupling of the armature to one of the diaphragms. The acoustic receiver also includes, for each of the front volumes, a sound outlet port acoustically coupled to the front volume.

The receiver is configured in one of numerous different implementations. The receivers generally have a housing with a first internal volume, a second internal volume, and a sound outlet. The sound outlet includes a first sound outlet port and a second sound outlet port. The receivers also include a first diaphragm separating the first internal volume into a first front volume and a first back volume and a second diaphragm separating the second internal volume into a second front volume and a second back volume smaller than the first back volume. The first front volume is acoustically coupled with the first sound outlet port, and the second front volume is acoustically coupled with the second sound outlet port. A motor, which includes an armature mechanically coupled to both the first diaphragm and the second diaphragm, is disposed at least partially inside the first back volume of the housing, and an acoustic seal is disposed between the first internal volume and the second internal volume. The acoustic seal accommodates the mechanical coupling of the armature to the second diaphragm while providing acoustic separation between the first internal volume and the second internal volume. The receivers also have at least one back-volume increasing structure attached externally to the housing and acoustically coupled with the second back volume to provide additional volume to the second back volume.

In some examples, the additional volume is at least the same volume as the second back volume, or the additional volume is at least twice the second back volume. In some examples, the additional volume is at least 5 $mm^3$ or at least 10 $mm^3$. In some examples, the housing has a first cross-section defining a first width and a first height, and the back-volume increasing structure is positioned to extend longitudinally with respect to a length of the housing and has a second cross-section defining a second width no greater than the first width and a second height no greater than the first height.

In some examples, the back-volume increasing structure is attached to a back wall of the housing opposite from the first or second sound outlet port. In some examples, the additional volume increases an acoustic compliance of the second back volume without decreasing an acoustic compliance of the first back volume. In some examples, the first back volume, the second back volume, and the additional volume are acoustically sealed from external ambient environment. In some examples, the additional volume increases an acoustic compliance of the first back volume.

In some embodiments, the additional volume is coupled to both the first and back volumes, decreasing the overall acoustic back volume compliance of the balanced-armature receiver. In some examples of these embodiments, the compliance of the first back volume may be decreased while the compliance of the second back volume is more significantly increased, thereby increasing the overall compliance of the balanced armature receiver. The total back volume compliance ($C_{total}$) of two back volumes can be expressed as $C_{total}=1/[(1/C_1)\pm(1/C_2)]$, where $C_1$ is the compliance of the first back volume, and $C_2$ is the compliance of the second back volume. To a first order, compliance of a back volume is proportional to the size of its air volume. For example, when only the second back volume (BV2) is acoustically coupled to the additional volume (V3), then $C_1$ is related to the first back volume (BV1) and $C_2$ is related to the combined volume of BV2 and V3. To a first order, when both back volumes are connected via third common volume (V3) to form a connected back volume ($BV_{connected}$), each diaphragm is exposed to a back volume compliance that is related to one half the total volume: $BV_{connected}=(BV1+BV2+V3)/2$.

In some examples, the back-volume increasing structure acoustically couples together the first back volume and the second back volume. According to some embodiments, a total volume of the second back volume and the additional volume differs from the first back volume by at least 10%. According to some embodiments, the back-volume increasing structure is a back-volume connection cup. According to some embodiments, the back-volume increasing structure includes a terminal board such that the terminal board at least partially defines the additional volume. Furthermore, the back-volume increasing structure may include a closed ring structure having a first portion attached externally to the housing and a second portion attached to the terminal board.

In some examples, the back-volume increasing structure is a sleeve into which the housing is slidably inserted. In some examples, the back-volume increasing structure includes a front isolation structure which slidably receives a first portion of the housing, a rear isolation structure which slidably receives a second portion of the housing, and an outer housing at least partially encasing the front isolation structure, the rear isolation structure, and the housing. In some examples, the acoustic seal is located between the first back volume and the second front volume. In some examples, the acoustic seal is located between the first front volume and the second back volume. In some examples, the sound outlet includes a nozzle.

Details regarding the receiver will be disclosed below in further details, with embodiments provided as nonlimiting examples of the different configurations and embodiments provided herein.

FIGS. 1, 3, 7, 10, 12, and 14 show examples of a balanced armature receiver 100 that has two sets of internal volumes within the housing 102: a first internal volume 114 and a second internal volume 116. A first diaphragm 104 separates a first front volume 120 from a first back volume 122 in the first internal volume 114. A second diaphragm 106 separates the second internal volume 116 into a second front volume 124 and a second back volume 126. An armature 200 included in the motor is coupled to the first diaphragm 104 or to the second diaphragm 106 by a link 136 which extends from the movable portion 210 of the armature 200 and through an opening 138 in a wall portion or separation wall 144 of the housing 102 which separates the first internal volume 114 from the second internal volume 116. In some examples, the first front volume 120 is acoustically coupled with a sound outlet port 140, and the second front volume 124 is acoustically coupled with a second sound outlet port 142. In some examples, the two sound outlet ports 140 and 142 are acoustically coupled with a sound outlet 118 of the receiver 100. In some examples, the sound outlet ports 140 and 142 may be separate and not acoustically coupled with each other.

Figure 7:
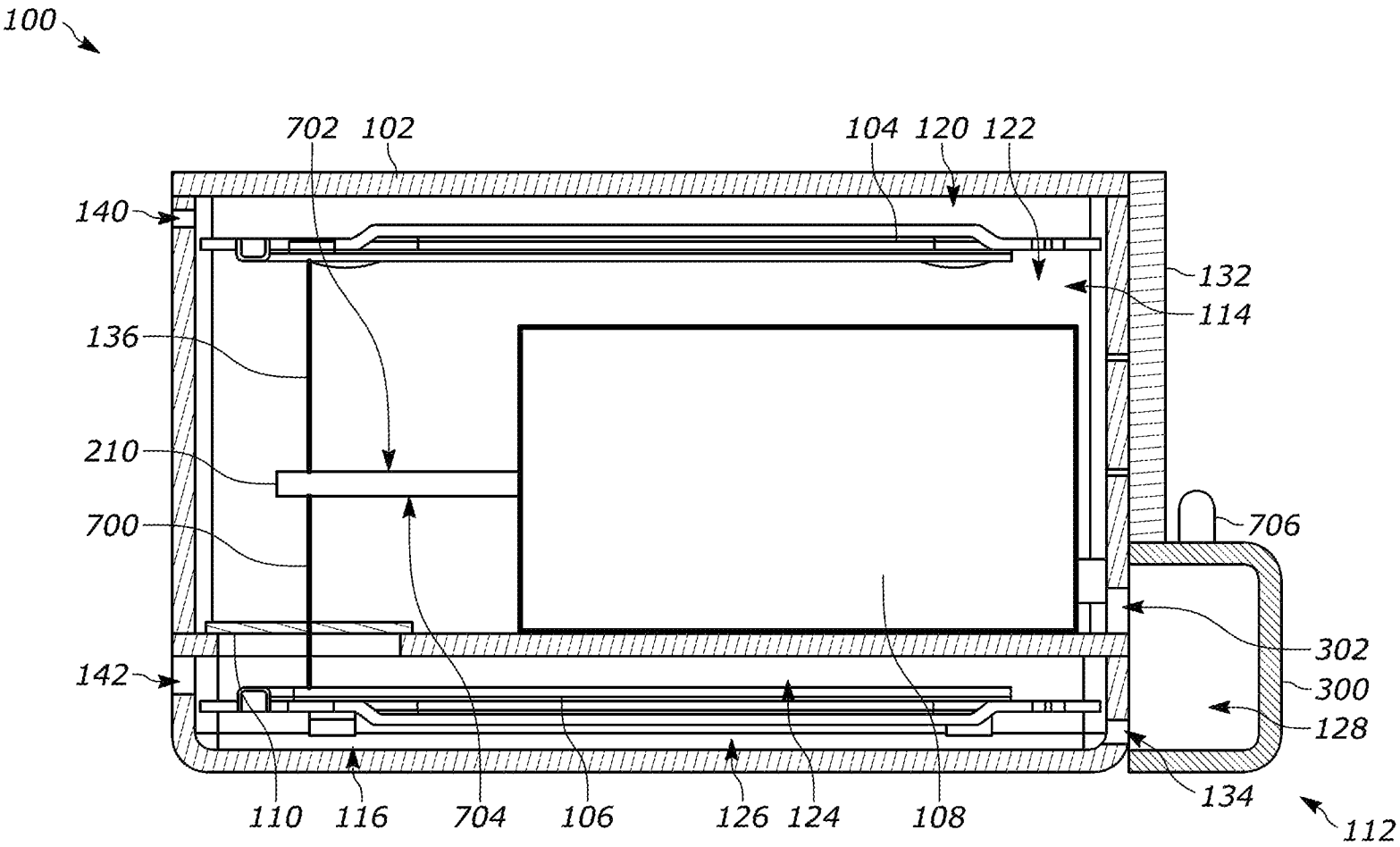
FIG. 7 shows a cross-sectional view of an acoustic receiver according to an embodiment.
Figure 14:
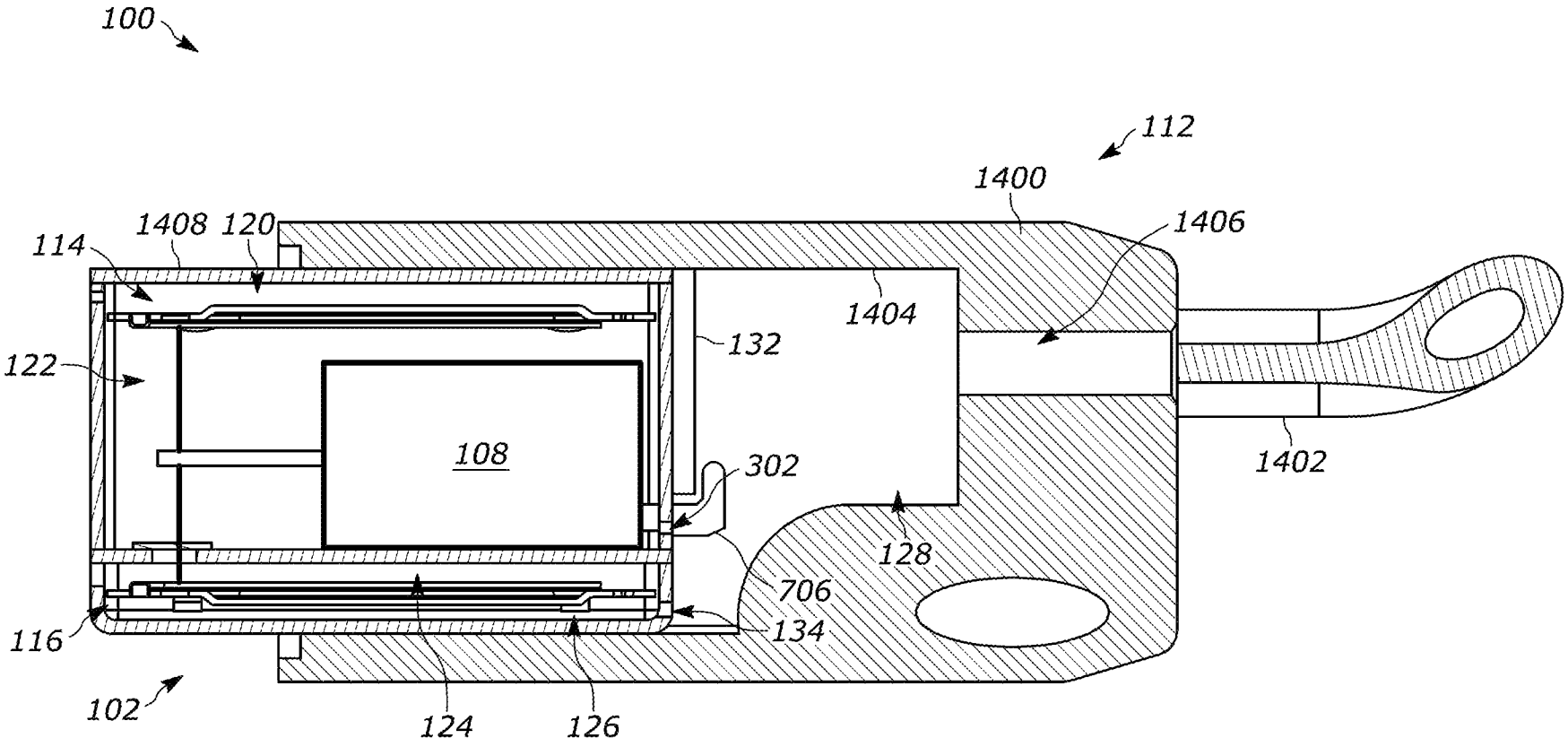
FIG. 14 shows a cross-sectional view of an acoustic receiver according to an embodiment.

The receiver 100 also includes an acoustic seal 110 disposed at or across the opening 138 of the separation wall 144 between the first internal volume 114 and the second internal volume 116 such that the acoustic seal 110 accommodates the mechanical coupling of the armature 200 to the second diaphragm 106 while providing acoustic separation between the first internal volume 114 and the second internal volume 116. Referring to FIGS. 1, 3, 10, and 12, the acoustic seal 110 is located between the first front volume 120 and the second back volume 126. Referring to FIGS. 7 and 14, the acoustic seal is located between the first back volume 122 and the second front volume 124. In some examples, there may be additional internal volume(s) and additional acoustic seal(s) therebetween, as suitable.

The acoustic seal 110 may be formed using a flexible material (for example, a flexible film) such as urethane or other polymers and forms an acoustic seal between the first internal volume 114 and the second internal volume 116. The acoustic seal provided by the film or other implementation described herein is characterized by an acoustic impedance that is greater than an acoustic impedance of a sound outlet port over a range of human detectable frequencies. Generally, any of the receivers described herein can use any of the acoustic seals, or a combination of flexible film acoustic seals, described herein. In some examples, the acoustic seal may be formed using a gel of any suitable material having a low stiffness so that it will have a low impact on the overall system stiffness but still solid enough to stay in place and maintain at least a partial seal.

The receiver 100 also includes a back-volume increasing structure 112 attached or affixed externally to the housing 102, such as to a backwall 130 of the housing. The back-volume increasing structure 112 acoustically couples with the second back volume 126 to provide additional volume 128 to the second back volume 126. A terminal board 132 may also be disposed on the backwall 130. The backwall 130 is the portion of the housing 102 that is opposite from the sound outlet 118. Having the back-volume increasing structure extending from the backwall may avoid increasing the width and the height of the receiver, as further explained herein. In some examples, the first back volume 122, the second back volume 126, and the additional volume 128 are acoustically sealed from external ambient environment.

The second back volume 126 includes an opening 134 which acoustically couples the second back volume with the additional volume 128, effectively using the additional volume to expand the second back volume. The back-volume increasing structure 112 can be of any suitable shape and size.

Figure 3:
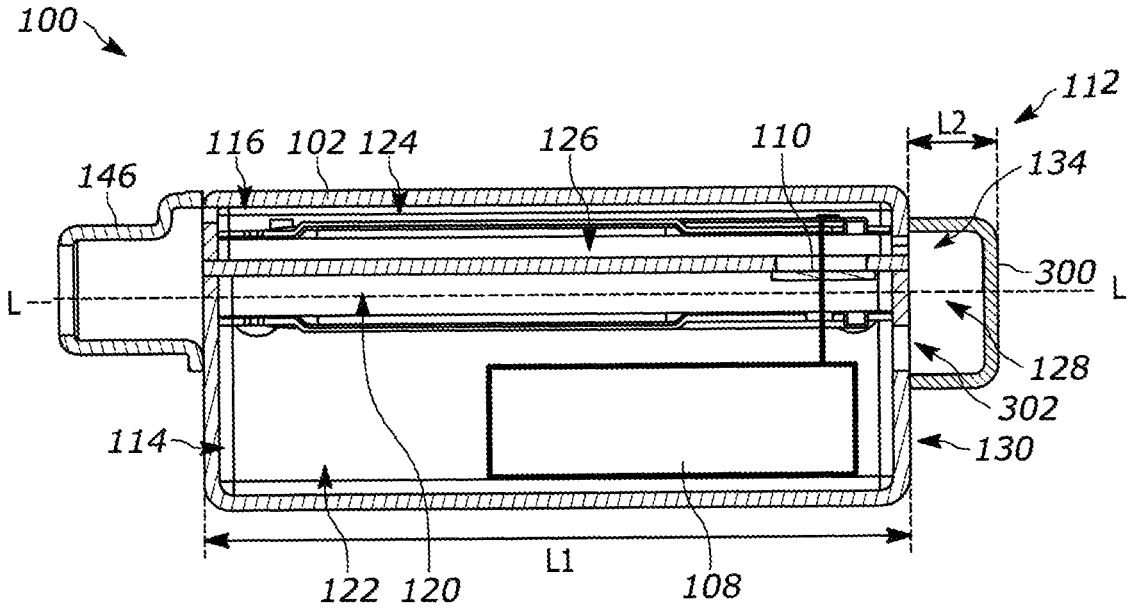
FIG. 3 shows a cross-sectional view of an acoustic receiver according to an embodiment.
Figure 4:
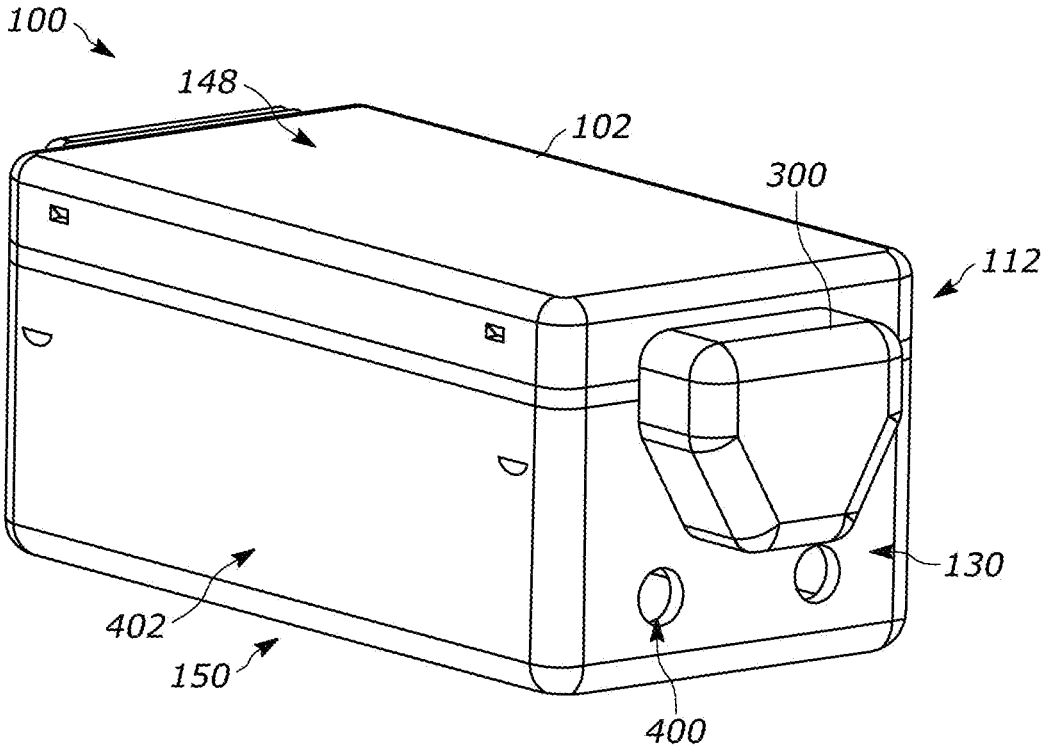
FIG. 4 shows an angled external view of the acoustic receiver of FIG. 3 according to an embodiment.
Figure 5:
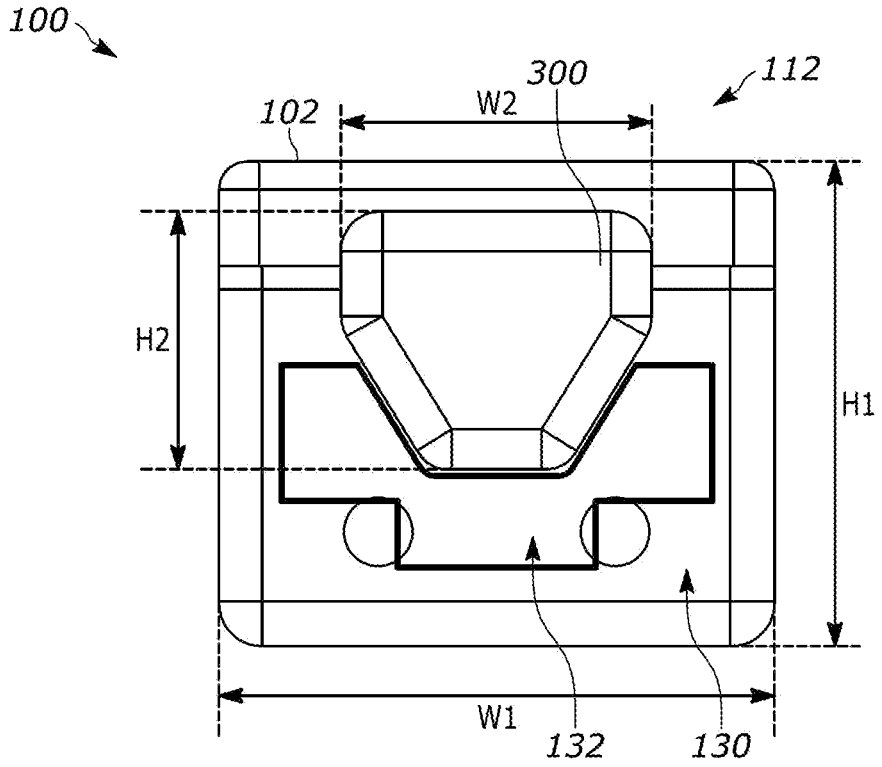
FIG. 5 shows an external back view of the acoustic receiver of FIG. 3 according to an embodiment.

Referring to FIGS. 3-7 and 9, the back-volume increasing structure 112 is a cup 300 which is attached to or affixed to an external surface of the housing 102 such as the backwall 130 thereof. The cup 300 may be any suitable shape. In FIGS. 4 and 5, the cup 300 has a substantially hexagonal cross-section, or resembling a truncated triangle configuration. The terminal board 132 may be shaped to partially surround the periphery of the cup 300 as shown in FIG. 4, where the terminal board 132 at least partially overlaps with one or more backwall openings 400 formed in the backwall 130 through which a portion of a coil 208 (or wires electrically coupled with the coil) of the motor 108 may extend therethrough, as further explained herein. The backwall openings 400 are acoustically sealed using a glue, adhesive, or any other suitable sealant material after the portion of coil (or wires) passes through the backwall openings.

Figure 6:
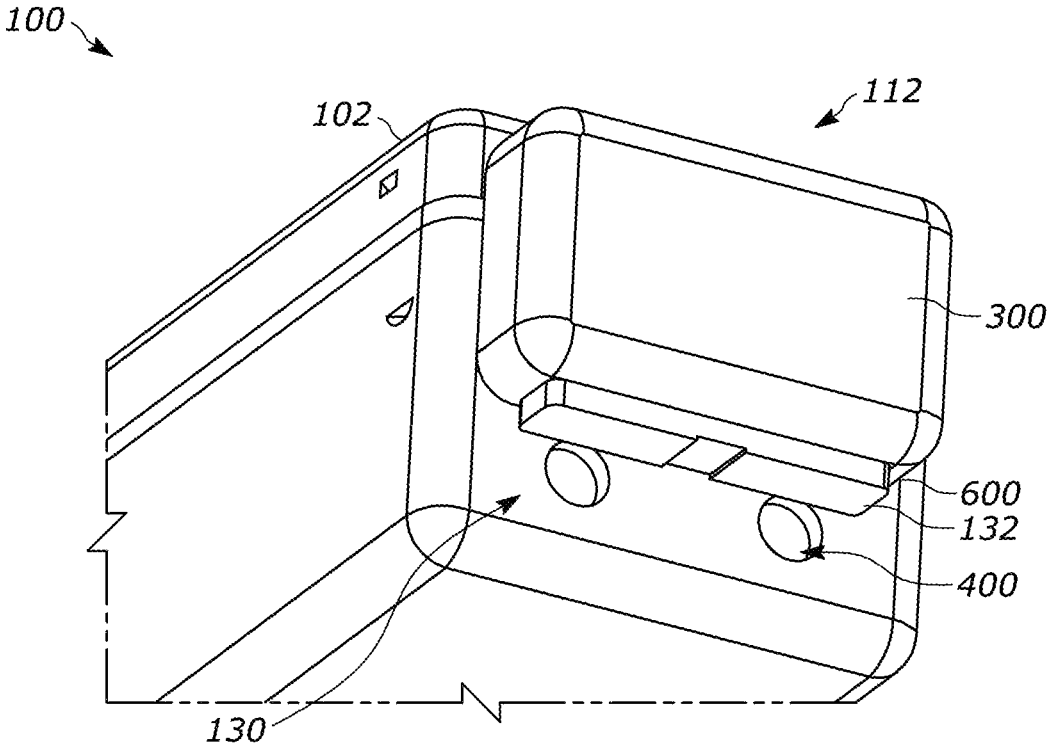
FIG. 6 shows an angled external view of an acoustic receiver according to an embodiment.

In FIG. 6, the cup 300 has a substantially rectangular cross-section. The terminal board 132 may be attached to a bottom portion 600 of the cup 300 and/or the backwall 130 to be positioned between the backwall openings 400 and the cup 300, for example.

Figure 9:
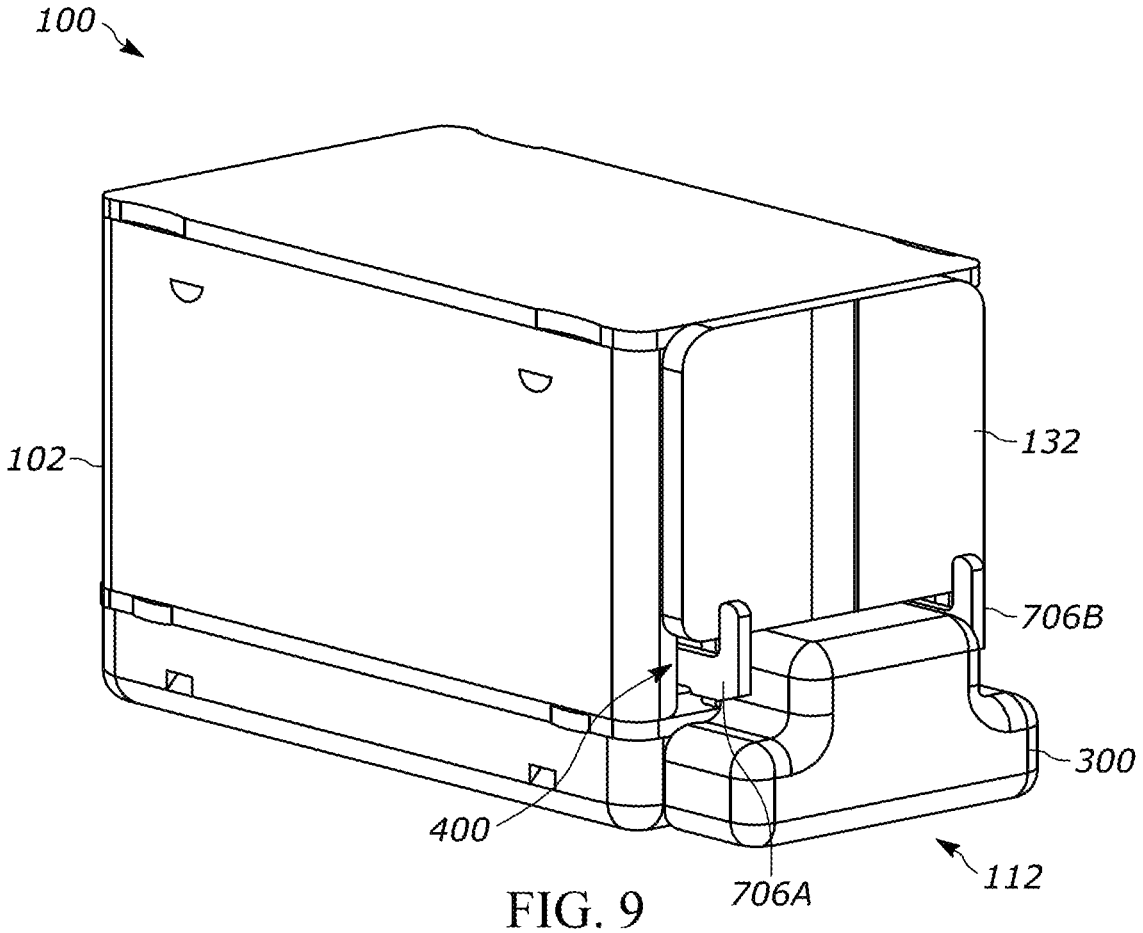
FIG. 9 shows an angled external view of the acoustic receiver of FIG. 7 according to an embodiment.

In FIG. 9, the cup 300 has a substantially octagonal cross-section, or resembling a truncated cross-shape configuration. A pair of electrical connection pins or contacts 706 extend from the motor 108 through the backwall openings 400 to the terminal board 132 as shown in FIGS. 7 and 9. The connection pins 706 (for example, 706A and 706B as shown in FIG. 9), which may be formed using pieces of conductive material, are located external to the additional volume 128 provided by the cup. As such, the shape of the cup 300 may be configured to avoid interacting or coming into contact with the connection pins 706. The connection pins 706 may be of any suitable configuration such as straight, curved, or L-shaped, for example. The connection pins 706 may be electrically coupled with a coil 208 of the motor, or more specifically to the two ends of the coil, as further explained herein. In any of these examples, the outer corners of the cross-sections of the cup 300 may be chamfered or curved so as to avoid forming sharp edges.

Figure 10:
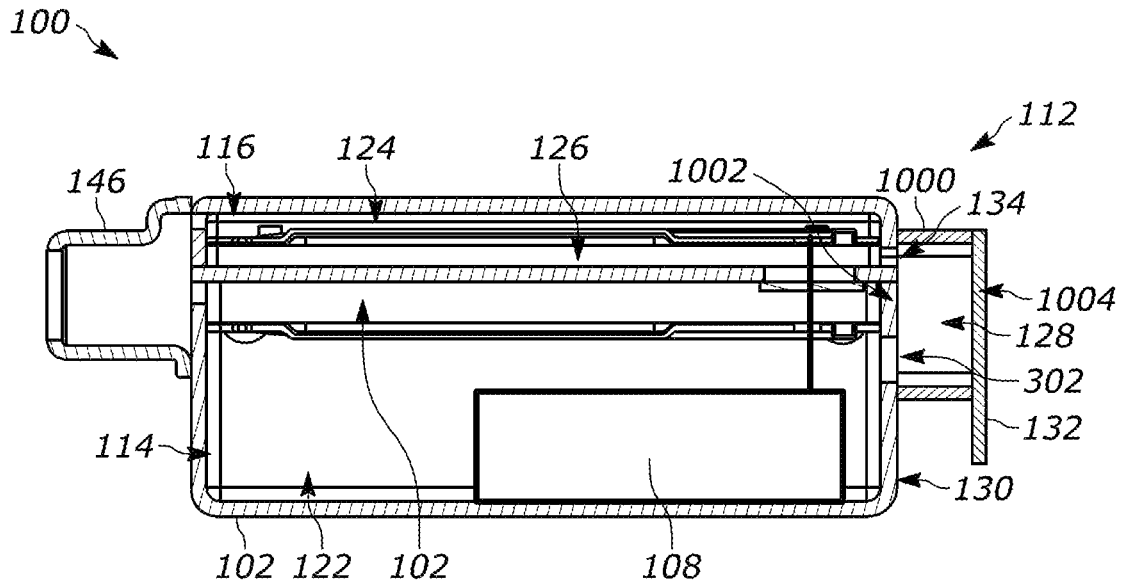
FIG. 10 shows a cross-sectional view of an acoustic receiver according to an embodiment.
Figure 11:
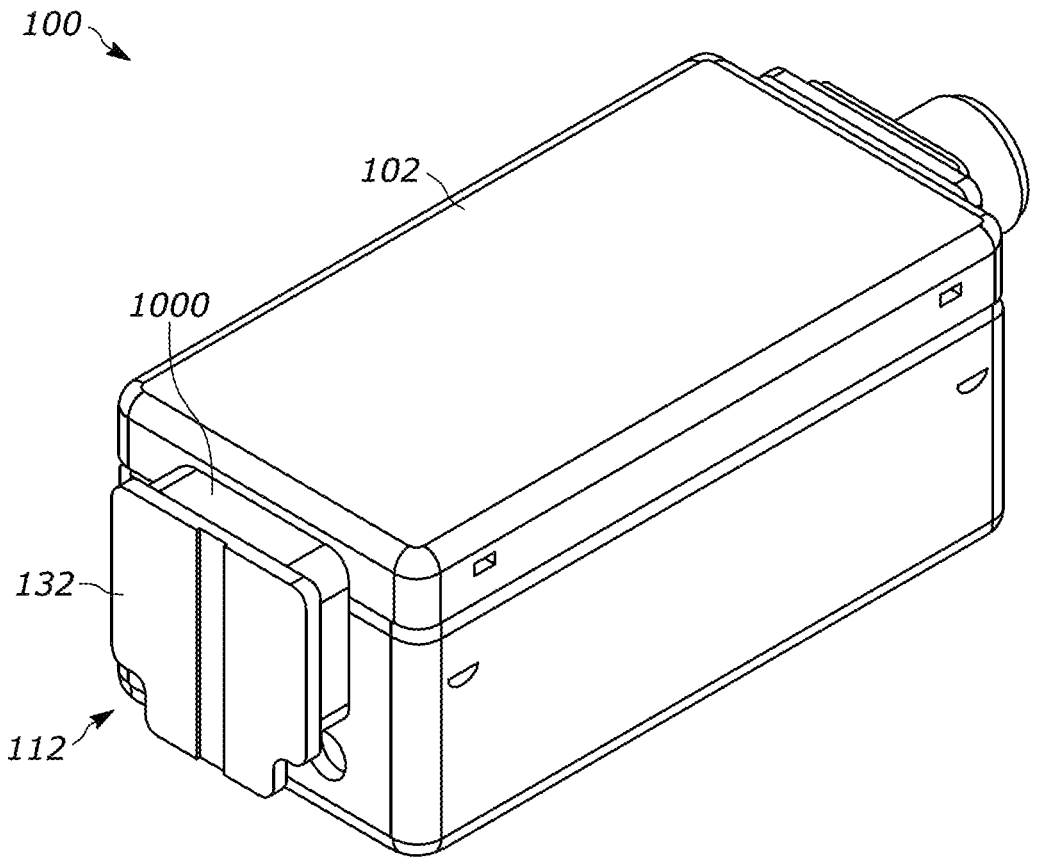
FIG. 11 shows an angled external view of the acoustic receiver of FIG. 10 according to an embodiment.

Referring to FIGS. 10 and 11, the back-volume increasing structure 112 is a combination of the terminal board 132 and a closed ring structure 1000. A first portion or first end 1002 of the closed ring structure is attached externally to the housing 102, and a second portion or second end 1004 of the closed ring structure is attached to the terminal board 132 such that the terminal board 132 functions as a backwall for the back-volume increasing structure 112. In some examples, the second end 1004 and the terminal board 132 are continuous and unitary with respect to each other.

Figure 12:
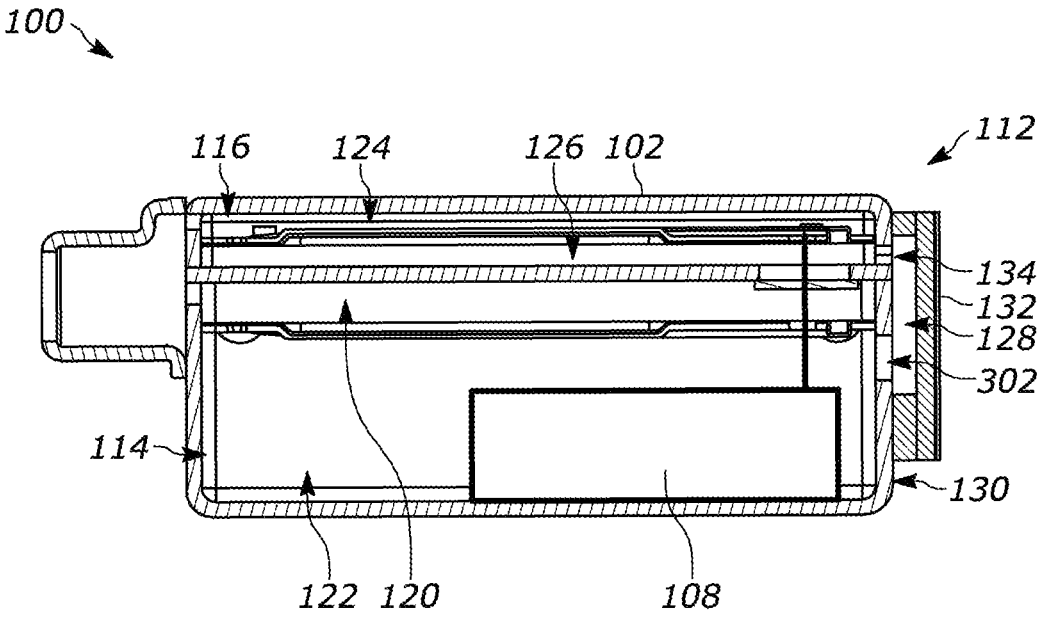
FIG. 12 shows a cross-sectional view of an acoustic receiver according to an embodiment.
Figure 13:
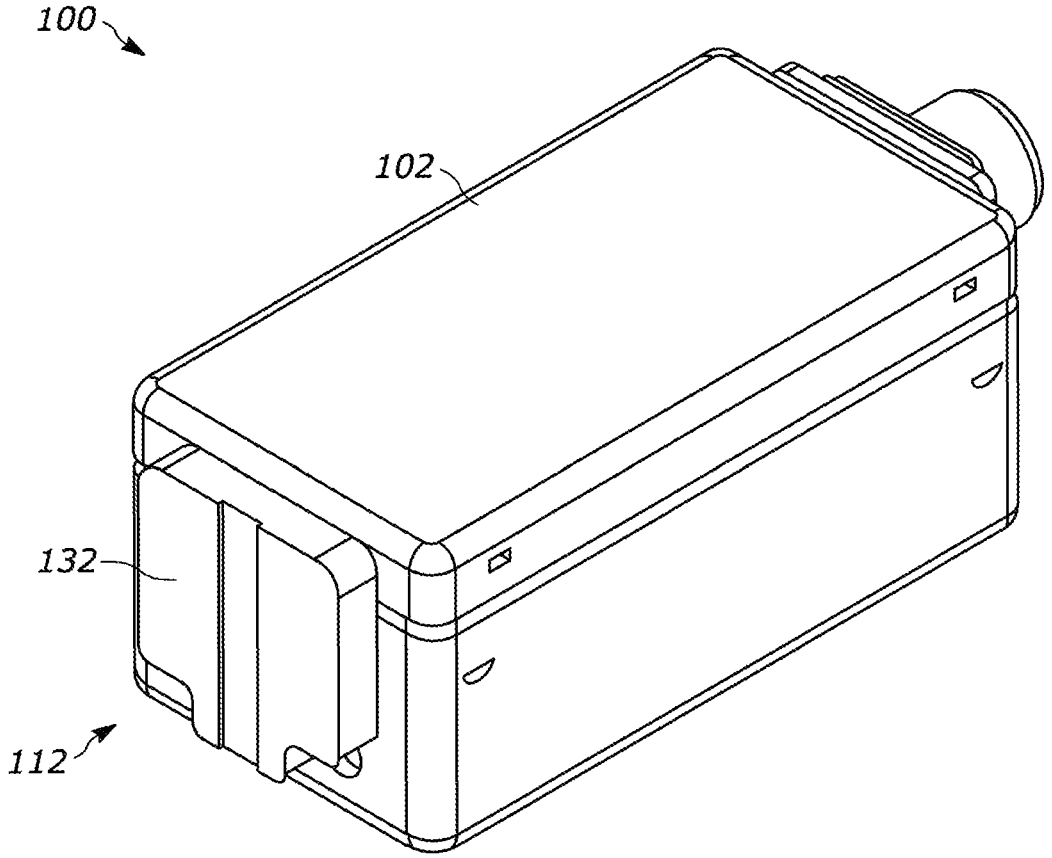
FIG. 13 shows an angled external view of the acoustic receiver of FIG. 12 according to an embodiment.

Referring to FIGS. 12 and 13, the back-volume increasing structure 112 is the terminal board 132 itself. The inner surface of the terminal board 132, therefore, defines the additional volume 128 for the second back volume 126.

Figure 15:
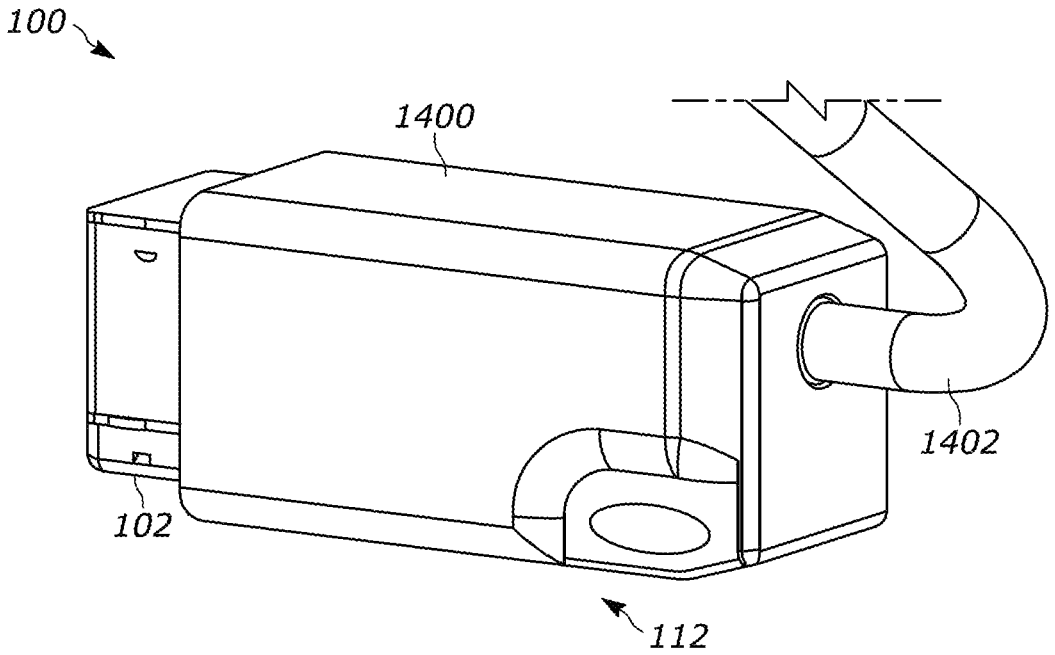
FIG. 15 shows an angled external view of the acoustic receiver of FIG. 14 according to an embodiment.

Referring to FIGS. 14 and 15, the back-volume increasing structure 112 is a sleeve 1400 with an inner spacing into which the housing 102 can be slidably inserted. The sleeve 1400 includes a tube 1402 with an aperture 1406 inside through which wires (not shown) are configured to pass. The aperture 1406 may be defined as a bore, opening, or internal space located within the tube 1402 and defined by the inner surface of the tube. The wires may be electrically coupled with the connection pins 706. A inner surface 1404 of the sleeve 1400 is configured to slidably receive a portion of the housing 102 as well as to provide the additional volume 128 for the receiver. In some examples, the inner surface 1404 of the sleeve 1400 forms a cavity having a size and a shape that are sufficient to slidably receive a portion of an outer surface 1408 of the housing 102 therein. In some examples, the inner surface 1404 of the sleeve 1400 may frictionally engage with a portion of the outer surface 1408 of the housing 102 to prevent the housing 102 from further movement into the cavity once the housing 102 is positioned at a specific location inside the cavity, or to prevent the housing 102 from being removed from the cavity.

In some examples, the inner surface 1404 may include a tab (not shown) positioned to prevent the housing 102 from being inserted past the position of the tab. In some examples, an adhesive material (not shown) may be applied to the outer surface 1408 of the housing 102 or the inner surface 1404 of the sleeve 1400 prior to insertion such that the outer surface 1408 and the inner surface 1404 are affixed at a predetermined position after the housing 102 is partially inserted into the cavity defined by the inner surface 1404 of the sleeve 1400. In some examples, the inserted portion of the housing 102 occupies no more than approximately 20%, approximately 30%, approximately 40%, approximately 50%, approximately 60%, approximately 70%, approximately 80%, approximately 90%, or any other suitable value or range therebetween, with respect to the total volume of the cavity within the sleeve 1400. In some examples, the second back volume 126 may be acoustically coupled to the additional volume 128 via the second back volume opening 134, and in some other examples, both back volumes 122 and 126 may be acoustically coupled to the additional volume 128 via the second back volume opening 134 and a first back volume opening 302.

Figure 16:
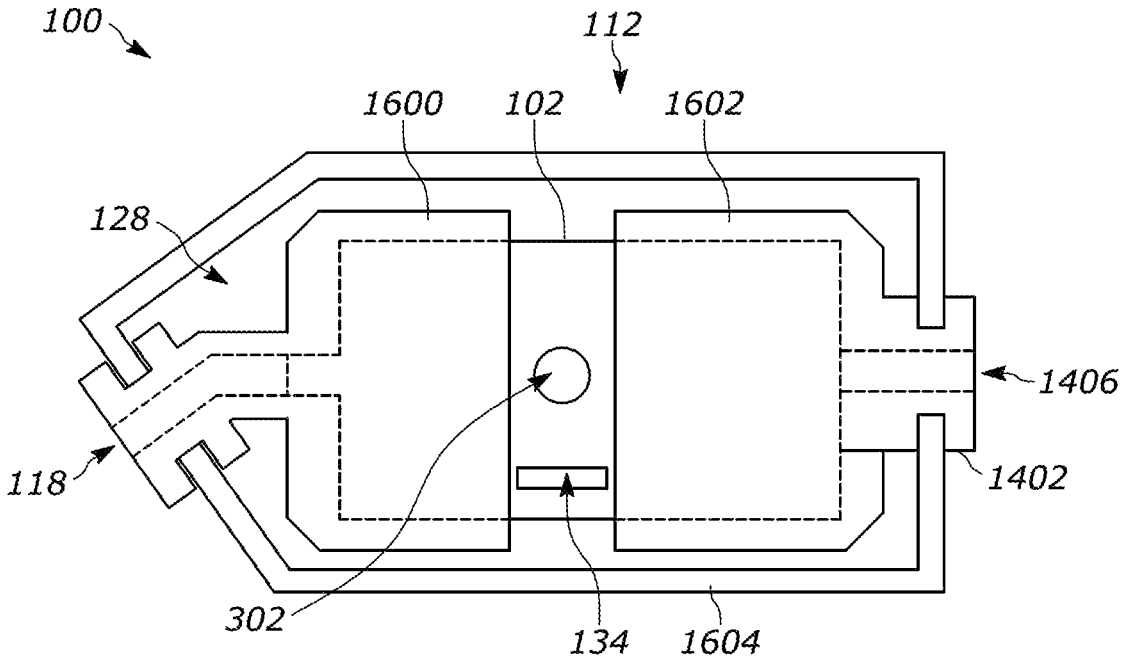
FIG. 16 shows a cross-sectional view of an acoustic receiver with portions of the receiver housing received within two isolation structures, which are encased within an outer housing, according to an embodiment.

Referring to FIG. 16, the back-volume increasing structure 112 is a combination of a front isolation structure 1600, a rear isolation structure 1602, and an outer housing or isolation housing 1604. The additional volume 128 is defined, at least in part, by the inner surfaces of the outer housing 1604 and the outer surfaces of the isolation structures 1600 and 1602. In some examples, the outer housing 1604 may be formed using a stiff material such as metal, in order to facilitate blocking or reducing electromagnetic radiation to penetrate through the material, as well as to facilitate locking in the back volume sound and provide sufficient weight to isolate vibration therein. The outer housing 1604 may at least partially envelope or encase the isolation structures 1600 and 1602, where only a portion of each isolation structure is exposed from the outer housing

1604. In some examples, the housing 102 of the receiver 100 may be isolated from the outer housing 1604 such that the housing 102 does not come into direct contact with the outer housing 1604 and remains in a state of suspension inside the outer housing 1604 via the front and rear isolation structures 1600 and 1602.

The isolation structures 1600 and 1602 may be made of a stiff or flexible material and are configured to slidably receive a portion of the housing 102 of the receiver such that one portion (with the sound outlet 118) is slidably received within the front isolation structure 1600, and another portion (with the wires extending therefrom) is slidably received within the rear isolation structure 1602. The rear isolation structure 1602 also at least partially defines the tube 1402 with the aperture 1406 extending therethrough to receive the wires. The isolation structures 1600 and 1602 in some examples do not come into direct contact with each other, leaving a space therebetween. Located in the space may be the second back volume opening 134 and a first back volume opening 302 which are acoustically coupled with the additional volume 128. It is to be understood that the first back volume opening 302 may not be present or required in some of the embodiments. As such, in these examples, the openings 134 and 302 are not located in the backwall 130 of the housing 102 but in a sidewall 402 of the housing 102, such as the one shown in FIG. 4 for example. In some examples, there may alternatively be opening(s) located in a top wall 148 and/or a bottom wall 150.

In some examples, as shown in FIG. 5, the back-volume increasing structure 112 may have a cross-section defining any suitable height H2 and width W2 such that the height H2 is no greater than a height H1 of the housing 102 and the width W2 is no greater than a width W1 of the housing 102. In some examples, as shown in FIGS. 1 and 3, the back-volume increasing structure 112 may have a longitudinally extending length L2 which extends longitudinally with respect to (or in the same direction as, or parallel to) a longitudinal length L1 of the housing 102. As such, in these examples, the back-volume increasing structure 112 would not significantly increase the cross-sectional area of the receiver 100. As referred to herein, the cross-section is taken in a direction substantially perpendicular to a longitudinal axis L-L of the housing 102 of the receiver as shown in FIG. 3, such that the measurements of L1 and L2 are taken substantially parallel to the axis L-L, and the measurements of H1, H2, W1, and W2 are taken substantially perpendicular to the axis L-L. Furthermore, the terms "length," "width," and "height" are understood to be the maximum length, width, and height, respectively, of the corresponding component.

FIGS. 1, 3, 10-13, and 16 show a nozzle 146 formed in or attached to the housing 102 which couples with at least one of the sound outlet ports (for example, the first sound outlet port 140 and/or the second sound outlet port 142). In these figures, the nozzle 146 is acoustically coupled with both of the sound outlet ports 140 and 142, which are directed toward the nozzle 146 such that any acoustic signal propagating from the sound outlet ports 140 and 142 is propagated from the nozzle into the ear canal via the sound outlet 118.

In FIG. 1, the additional volume 128 defined by the back-volume increasing structure 112 is acoustically coupled with only the second back volume 126 via the second back volume opening 134. As such, the additional volume 128 may increase the acoustic compliance of the second back volume 126 without decreasing the acoustic compliance of the first back volume 122.

In FIGS. 3, 7, 10, 12, 14, and 16, the additional volume 128 (which may be defined by the cup 300, the terminal board 132, the combination of the terminal board 132 with the closed ring structure 1000, the sleeve 1400, or the outer housing 1604, as suitable) is acoustically coupled to both the first back volume 122 and the second back volume 126 via the first back volume opening 302 and the second back volume opening 134. As such, the additional volume 128 may increase the acoustic compliance of the second back volume 126 and may also increase the acoustic compliance of the first back volume 122.

As used herein, an "acoustic compliance," also known as acoustic capacitance, is the reciprocal of acoustic stiffness, which is defined by dividing an acoustic air pressure (P) developed in a volume (V), for example the back volume, by the temporary and reversible change in the size of that volume (ΔV). Assuming an adiabatic system, the acoustic stiffness of an air volume is approximately related to the size of the volume (V), the density of air (φ, and the speed of sound in that air (c), as expressed using the following equation:

$$\text{Acoustic Stiffness} = \frac{P}{-\Delta V} = \frac{\rho c^2}{V} \qquad \text{(Equation 1)}$$

As such, the acoustic compliance of a component is proportional to the volume of air inside the component. Increasing the acoustic compliance of a receiver reduces the stiffness of the back volume(s) of the receiver such that the armature and the diaphragms can move more freely in response to an actuation signal provided to the motor, thereby increasing acoustic output of the receiver. In some examples, implementing the additional volume may increase the total acoustic compliance by at least approximately 30%, 50%, 70%, 100%, 150%, 200%, or any other suitable value or range therebetween, as compared to without the additional volume.

The total back volume compliance ($C_{total}$) of two back volumes can be expressed using the following equation:

$$C_{total} = \frac{1}{\frac{1}{C_1} + \frac{1}{C_2}} \qquad \text{(Equation 2)}$$

where $C_1$ is the compliance of the first back volume, and $C_2$ is the compliance of the second back volume. In some examples where the additional volume is coupled to both the first and second back volumes, the compliance of the first back volume $C_1$ may be decreased while the compliance of the second back volume $C_2$ is increased, thereby increasing the overall compliance $C_{total}$ of the balanced armature receiver. As an illustrative example, with no units implied, if an initial system has initial values of $C_1$=90 and $C_2$=10, then the initial total compliance of the system has a value of $C_{total}$=9. If this initial system is changed as a result of coupling the additional volume to both the first and second back volumes such that that $C_1$ is decreased by 30 (i.e., from 90 to 60) but $C_2$ is increased by 50 (i.e., from 10 to 60), then the total compliance $C_{total}$ increases from 9 to 30. Alternatively, if the aforementioned initial values of $C_1$ and $C_2$ are instead changed by an equal amount of 40 but in opposite directions (i.e., $C_1$ decreases by 40 while $C_2$ increases by 40) such that the two resulting values are $C_1$=$C_2$=50 after the change, then the total compliance $C_{total}$ increases from 9 to 25. In both of these examples, the total compliance $C_{total}$ increases while $C_1$ decreases.

The value of the first back volume 122 is hereinafter represented by "BV1," the value of the second back volume 126 is hereinafter represented by "BV2," and the value of the additional volume 128 is hereinafter represented by "V3." The values of BV1, BV2, and V3 may vary according to the embodiments. In some embodiments, V3 is at least the same as or greater than BV2. In some embodiments, V3 is at least approximately 1.5 times, 2 times, 3 times, 4 times, 5 times, or any other suitable value or range therebetween with respect to BV2. In some examples, V3 is at least approximately 3 $mm^3$, 5 $mm^3$, 10 $mm^3$, 15 $mm^3$, 20 $mm^3$, 30 $mm^3$, or any other suitable value or range therebetween. In some embodiments, the relationship between the volumes may be represented by either BV2+V3>BV1 or BV2+V3<BV1. In some examples when BV2+V3>BV1, the total of BV2+V3 is at least approximately 10% greater than BV1, 10% greater than BV1, 20% greater than BV1, 30% greater than BV1, 50% greater than BV1, 70% greater than BV1, 100% greater than BV1, or any other suitable value or range therebetween. In some examples when BV2+V3<BV1, the total of BV2+V3 is no greater than approximately 90% of BV1, 70% of BV1, 50% of BV1, 30% of BV1, or any other suitable value or range therebetween.

To a first order, compliance of a back volume is proportional to the size of its air volume. For example, when only BV2 is acoustically coupled to V3, then $C_1$ of Equation 2 is related to BV1 and $C_2$ is related to the combined volume of BV2 and V3. To a first order, when both back volumes are connected via V3 (a common volume to BV1 and BV2) to form a connected back volume ($BV_{connected}$), each diaphragm is exposed to a back volume compliance that is related to one half the total volume by the following equation:

$$BV_{connected}=(BV1+BV2+V3)/2. \quad \text{(Equation 3)}$$

Figure 2:
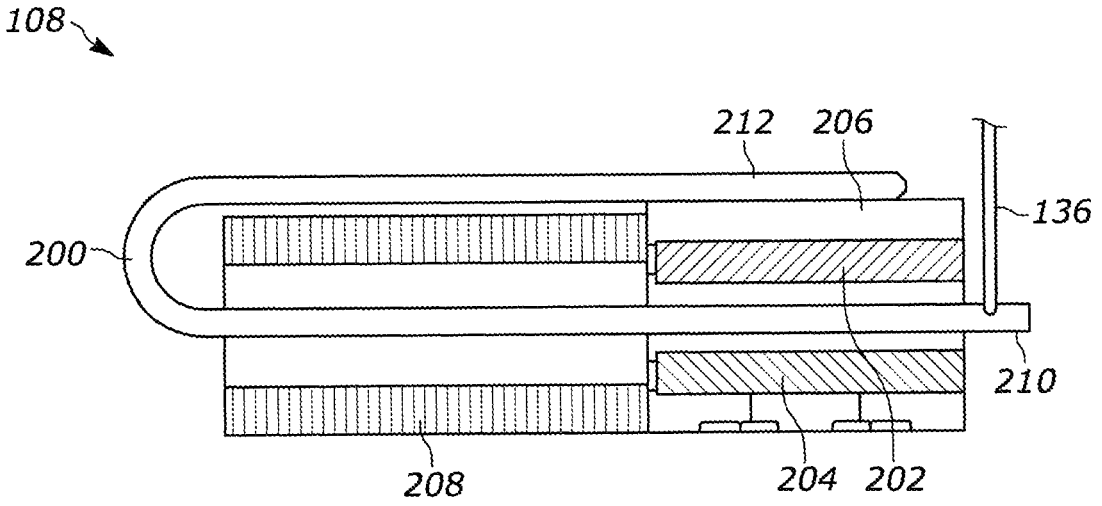
FIG. 2 shows a cross-sectional view of a motor as implemented in the acoustic receiver of FIG. 1 according to an embodiment.
Figure 8:
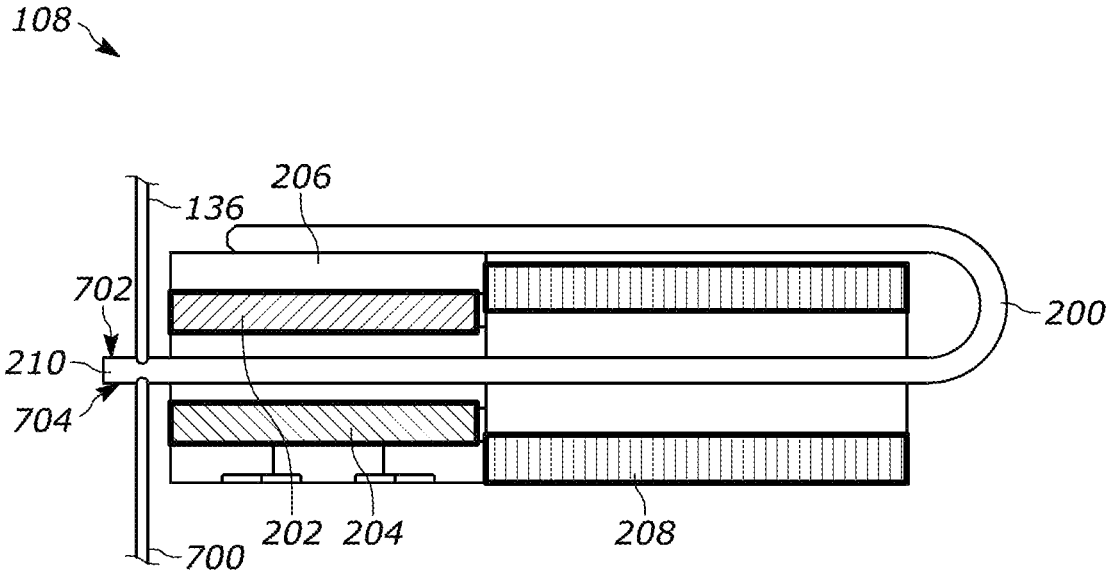
FIG. 8 shows a cross-sectional view of a motor as implemented in the acoustic receiver of FIG. 7 according to an embodiment.
Figure 18:
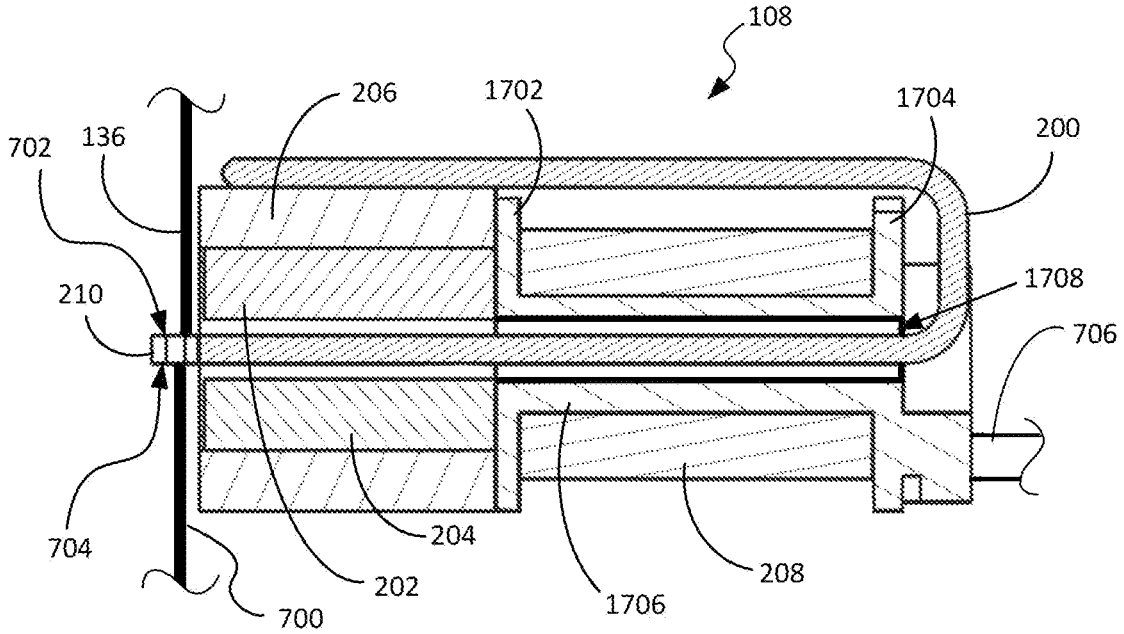
FIG. 18 shows a cross-sectional view of a motor implementing the bobbin of FIG. 17 according to an embodiment.

Referring to FIGS. 2, 8, and 18, the motor 108 includes the armature 200 (also known as a reed) and a pair of magnets 202, 204 disposed at a yoke 206, as well as one or more coil 208 disposed around a portion of the armature. The motor 108 is powered via wires (not shown in FIGS. 2 and 8, configured as pins 706 in FIG. 18) extending therefrom and leading to the electrical terminal board or interface 132 of the receiver 100. In some examples, the coil 208 is attached to the housing 102 or the yoke 206 for support. The first diaphragm 104 and the second diaphragm 106 may be either hinged or unhinged and exhibiting pistonic action. The yoke holds the pair of magnets 202, 204 between which a movable portion 210 of the armature extends, whereas an immobile portion 212 of the armature is fixed or attached to the yoke. The movable portion of the armature is configured to deflect relative to the magnets in response to the application of an electrical signal to the coil. U-shaped armatures are shown but other armatures such as E-shaped and M-shaped armatures are known in the art and may be used alternatively.

The motor 108 of FIG. 2 is configured to be positioned such that the magnets 202 and 204 are positioned closer to the backwall 130 of the housing 102 than the coil 208 (that is, the magnets are located between the coil and the backwall). As such, the wires may extend around the yoke 206 and the magnets to electrically couple the coil 208 with the terminal board 132. Furthermore, there is the single link 136 which couples the movable portion 210 of the armature 200 of the motor 108 with both diaphragms 104 and 106.

The motor 108 of FIGS. 8 and 18 according to some examples may be positioned in the first back volume 122 such that the coil 208 is located between the magnets 202, 204 and the backwall 130, and the wires may extend from the coil without having to extend around the yoke 206 or the magnets. The first link 136 extends from a first surface 702 of the armature 200 and a second link 700 extends from a second surface 704 of the armature 200 that is opposite from the first surface 702. The first link 136 and the second link 700 couple with the first diaphragm 104 and the second diaphragm 106, respectively. In some examples, the locations of the diaphragms 104, 106 are unrelated to the orientation of the motor 108, therefore the movable portion 210 of the armature 200 may be oriented toward the sound outlet 118 or toward the backwall 130 regardless of where the diaphragms 104, 106 are located with respect to the motor 108. In some examples, the links 136 and 700 may be formed of a singular piece of material. In FIG. 18, the coil 208 is electrically coupled with the terminal board via the connection pins or contacts 706, and the coil is disposed around a bobbin 1700 as shown in FIG. 17.

Figure 17:
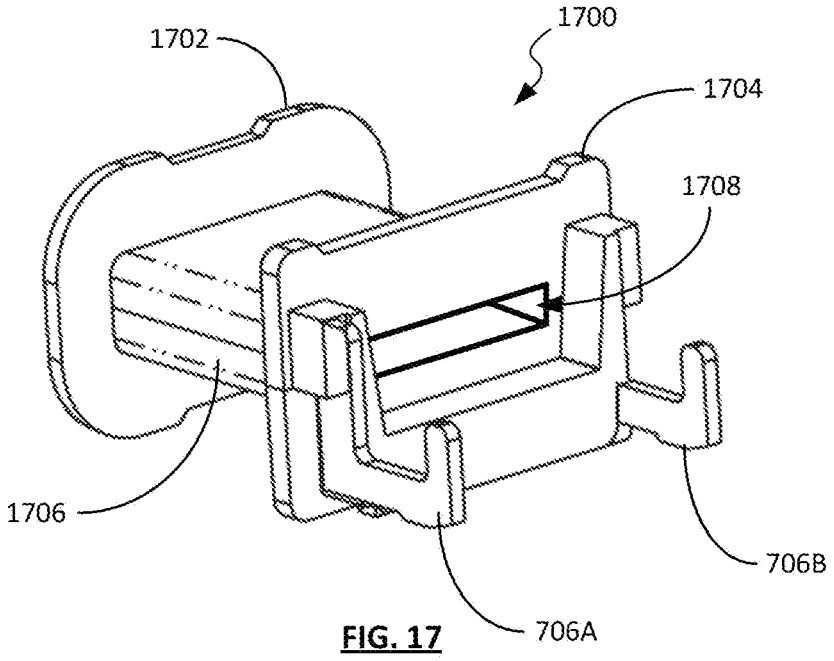
FIG. 17 shows an angled view of a bobbin according to an embodiment.

FIG. 17 shows an example of the bobbin 1700 which includes a coil support member 1706 as well as a first flange 1702 and a second flange 1704 which extend from the two different locations along the length of the coil support member. The flanges 1702 and 1704 may extend outwardly with respect to the coil support member, for example substantially perpendicularly from the coil support member or from the longitudinal axis L-L of the receiver 100. The coil support member is configured to support the coil 208 by having the body of the coil wrapped around the coil support member, and the coil support member also includes a coil tunnel 1708 through which the movable portion 210 of the armature 200 can be extended. The first flange is positioned between the coil 208 and the yoke 206 or the magnets 202, 204. The connection pins 706 (for example, 706A and 706B) may extend from the second flange in a direction substantially parallel to the longitudinal axis L-L and away from the first flange. The bobbin may be formed using a nonconductive material such as plastic or polymer resin, or any other suitable material.

In some examples, the receiver housing (such as the housing 102) is formed as a single monolithic component, whereas in other examples, the housing is formed by coupling together two or more separate subcomponents. Different means of coupling may be employed as suitable, for example gluing, clamping, fastening, attaching, welding, etc. In the examples where two subcomponents are involved, the subcomponents may be referred to a cover and a cup. In some examples, the cover at least partially defines one or more front volume, and the cup at least partially defines one or more back volume. In some examples, the cover at least partially defines one or more sound outlet port, and the cup at least partially defines one or more back volume vent. In some examples, the cover or the cup is also formed by coupling together two or more separate subcomponents. For example, the cup has one subcomponent that defines the sidewalls and another subcomponent that defines the bottom base portion. Furthermore, the components that are referred to as the "wall" of the housing can also be referred to as a "cover", or vice versa, in different embodiments.

While the present disclosure and what is presently considered to be the best mode thereof has been described in a manner that establishes possession by the inventors and that enables those of ordinary skill in the art to make and use the same, it will be understood and appreciated that there are many equivalents to the exemplary embodiments disclosed herein and that myriad modifications and variations may be made thereto without departing from the scope and spirit of the disclosure, which is to be limited not by the exemplary embodiments but by the appended claims.

What is claimed is:

1. A balanced armature receiver comprising:

a housing having a first internal volume, a second internal volume, and a sound outlet comprising a first sound outlet port and a second sound outlet port;

a first diaphragm separating the first internal volume into a first front volume and a first back volume, the first front volume acoustically coupled with the first sound outlet port;

a second diaphragm separating the second internal volume into a second front volume and a second back volume smaller than the first back volume, the second front volume acoustically coupled with the second sound outlet port;

a motor disposed at least partially inside the first back volume of the housing, the motor including an armature mechanically coupled to both the first diaphragm and the second diaphragm;

an acoustic seal between the first internal volume and the second internal volume, the acoustic seal accommodating the mechanical coupling of the armature to the second diaphragm while providing acoustic separation between the first internal volume and the second internal volume; and at least one back-volume increasing structure attached externally to the housing and acoustically coupled with the second back volume to provide additional volume to the second back volume.

2. The balanced armature receiver of claim 1, wherein the additional volume is at least the same volume as the second back volume.

3. The balanced armature receiver of claim 1, wherein the additional volume is at least twice the second back volume.

4. The balanced armature receiver of claim 1, wherein the additional volume is at least 5 $mm^3$.

5. The balanced armature receiver of claim 1, wherein the additional volume is at least 10 $mm^3$.

6. The balanced armature receiver of claim 1, wherein the housing has a first cross-section defining a first width and a first height, and the back-volume increasing structure is positioned to extend longitudinally with respect to a length of the housing and has a second cross-section defining a second width no greater than the first width and a second height no greater than the first height.

7. The balanced armature receiver of claim 1, wherein the back-volume increasing structure is attached to a back wall of the housing opposite from the sound outlet.

8. The balanced armature receiver of claim 1, wherein the additional volume increases an acoustic compliance of the second back volume without decreasing an acoustic compliance of the first back volume.

9. The balanced armature receiver of claim 1, wherein the first back volume, the second back volume, and the additional volume are acoustically sealed from external ambient environment.

10. The balanced armature receiver of claim 1, wherein the additional volume is configured to increase an acoustic compliance of the first back volume.

11. The balanced armature receiver of claim 1, wherein the back-volume increasing structure is configured to acoustically couple the first back volume and the second back volume.

12. The balanced armature receiver of claim 11, wherein a total volume of the second back volume and the additional volume differs from the first back volume by at least 10%.

13. The balanced armature receiver of claim 11, wherein the back-volume increasing structure is a back-volume connection cup.

14. The balanced armature receiver of claim 11, wherein the back-volume increasing structure comprises a terminal board such that the terminal board at least partially defines the additional volume.

15. The balanced armature receiver of claim 14, wherein the back-volume increasing structure further comprises a closed ring structure having a first portion attached externally to the housing and a second portion attached to the terminal board.

16. The balanced armature receiver of claim 1, wherein the back-volume increasing structure is a sleeve into which the housing is configured to be slidably inserted.

17. The balanced armature receiver of claim 1, wherein the back-volume increasing structure comprises:

a front isolation structure configured to slidably receive a first portion of the housing;

a rear isolation structure configured to slidably receive a second portion of the housing; and an outer housing at least partially encasing the front isolation structure, the rear isolation structure, and the housing.

18. The balanced armature receiver of claim 1, wherein the acoustic seal is located between the first back volume and the second front volume.

19. The balanced armature receiver of claim 1, wherein the acoustic seal is located between the first front volume and the second back volume.

20. The balanced armature receiver of claim 1, wherein the sound outlet includes a nozzle.

* * * * *